US008348405B2

(12) United States Patent
Smith et al.

(10) Patent No.: US 8,348,405 B2
(45) Date of Patent: Jan. 8, 2013

(54) SYSTEM AND METHOD FOR TRANSPORTING SOLID INK PELLETS

(75) Inventors: Nathan Eymard Smith, Hamlin, NY (US); Michael Fredrick Leo, Penfield, NY (US); Patrick James Walker, Rochester, NY (US); Robert R. Tuchrelo, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 337 days.

(21) Appl. No.: 12/874,363

(22) Filed: Sep. 2, 2010

(65) Prior Publication Data

US 2012/0056959 A1 Mar. 8, 2012

(51) Int. Cl.
*B41J 2/175* (2006.01)

(52) U.S. Cl. ..... 347/88; 347/84; 347/85; 347/99

(58) Field of Classification Search ..... 347/84–86, 347/88, 99

See application file for complete search history.

(56) References Cited

U.S. PATENT DOCUMENTS

| | | | | |
|---|---|---|---|---|
| 4,234,885 | A * | 11/1980 | Arway | 347/85 |
| 5,181,049 | A * | 1/1993 | Mackay et al. | 347/88 |
| 5,725,160 | A * | 3/1998 | Harper et al. | 239/654 |
| 5,910,810 | A * | 6/1999 | Brooks et al. | 347/88 |
| 6,665,505 | B2 * | 12/2003 | Meetze et al. | 399/106 |
| 7,302,212 | B2 * | 11/2007 | Leute | 399/258 |
| 7,303,362 | B2 * | 12/2007 | Dunlop et al. | 406/42 |
| 7,380,928 | B2 * | 6/2008 | Leighton | 347/99 |
| 7,604,336 | B2 * | 10/2009 | Leighton | 347/88 |
| 7,643,776 | B2 * | 1/2010 | Walton et al. | 399/237 |
| 7,887,173 | B2 * | 2/2011 | Jones | 347/88 |
| 8,186,818 | B2 * | 5/2012 | Jones et al. | 347/88 |
| 8,240,830 | B2 * | 8/2012 | Jones et al. | 347/88 |
| 2003/0117892 | A1 | 6/2003 | Litwiller | |
| 2006/0227192 | A1 * | 10/2006 | Leighton | 347/88 |
| 2006/0227193 | A1 * | 10/2006 | Leighton | 347/99 |
| 2007/0025774 | A1 * | 2/2007 | Leute | 399/258 |

(Continued)

FOREIGN PATENT DOCUMENTS

| | | |
|---|---|---|
| EP | 1 101 617 A2 | 5/2001 |
| EP | 1 101 618 A1 | 5/2001 |

(Continued)

OTHER PUBLICATIONS

UK Search Report corresponding to GB Patent Application GB1113957.3, UKIPO, Newport, South Wales, Nov. 28, 2011 (3 pages).

*Primary Examiner* — Matthew Luu
*Assistant Examiner* — Rut Patel
(74) *Attorney, Agent, or Firm* — Maginot, Moore & Beck, LLP

(57) ABSTRACT

A molten ink supply for a solid ink printing machine includes a container for storing solid ink pellets and a withdrawal tube having an inlet end disposed within the container. A vacuum generator is disposed at the outlet end of the withdrawal tube operable to draw a vacuum within the tube. A feed conduit is connected to the outlet end for receiving solid ink pellets drawn therein by said vacuum generator and conveying the pellets to a melting station operable to melt the solid ink pellets. An assist tube is provided within the container with a discharge nozzle disposed within the withdrawal tube at the inlet end and operable to provide a flow of air into the withdrawal tube to agitate solid ink pellets and facilitate withdrawal of the pellets by the vacuum generator.

29 Claims, 2 Drawing Sheets

U.S. PATENT DOCUMENTS

| | | | | |
|---|---|---|---|---|
| 2008/0100677 | A1* | 5/2008 | Boyer | 347/84 |
| 2009/0185016 | A1 | 7/2009 | Jones | |
| 2009/0273658 | A1* | 11/2009 | Freitag et al. | 347/88 |
| 2011/0193917 | A1* | 8/2011 | Enderle et al. | 347/85 |
| 2012/0026258 | A1* | 2/2012 | Leighton et al. | 347/88 |
| 2012/0044303 | A1* | 2/2012 | Park | 347/85 |
| 2012/0075390 | A1* | 3/2012 | Park et al. | 347/85 |
| 2012/0098898 | A1* | 4/2012 | Park et al. | 347/85 |
| 2012/0154493 | A1* | 6/2012 | Deshiikan et al. | 347/88 |

FOREIGN PATENT DOCUMENTS

| | | | |
|---|---|---|---|
| EP | 1 424 203 | A2 | 11/2003 |
| EP | 1 810 830 | A1 | 7/2007 |

* cited by examiner

SYSTEM AND METHOD FOR TRANSPORTING SOLID INK PELLETS

TECHNICAL FIELD

The present disclosure relates to ink-jet printing, particularly involving phase-change inks printing on a substantially continuous web.

BACKGROUND

Ink jet printing involves ejecting ink droplets from orifices in a print head onto a receiving surface to form an image. The image is made up of a grid-like pattern of potential drop locations, commonly referred to as pixels. The resolution of the image is expressed by the number of ink drops or dots per inch (dpi), with common resolutions being 300 dpi and 600 dpi.

Ink-jet printing systems commonly utilize either a direct printing or offset printing architecture. In a typical direct printing system, ink is ejected from jets in the print head directly onto the final receiving web. In an offset printing system, the image is formed on an intermediate transfer surface and subsequently transferred to the final receiving web. The intermediate transfer surface may take the form of a liquid layer that is applied to a support surface, such as a drum. The print head jets the ink onto the intermediate transfer surface to form an ink image thereon. Once the ink image has been fully deposited, the final receiving web is then brought into contact with the intermediate transfer surface and the ink image is transferred to the final receiving web.

FIG. 1 provides a simplified view of a direct-to-sheet, continuous-media, phase-change ink printing machine. A media supply and handling system is configured to supply a long (i.e., substantially continuous) web of media W of "substrate" (paper, plastic, or other printable material) from a media source, such as spool of media 10. In certain printing machines the web W passes through a series of tensioning rollers 12 to a pre-heater 18 that brings the web to an initial predetermined temperature that is selected for desired image characteristics corresponding to the type of media being printed as well as the type, colors, and number of inks being used. The media is then transported through a printing station 20 that includes a series of print head modules 21A, 21B, 21C, and 21D, each printhead module effectively extending across the width of the media and being able to place ink directly (i.e., without use of an intermediate or offset member) onto the moving media. As is generally familiar, each of the print heads may eject a single color of ink, one for each of the colors typically used in color printing, namely, cyan, magenta, yellow, and black (CMYK). Image data obtained from an image processor, such as a scanner (not shown) is provided to a controller 22 that controls the operation of the print heads as well as the delivery of molten ink from the ink supply 24 to the print heads.

Following the printing zone 20 along the media path are one or more "mid-heaters" 30 that may use contact, radiant, conductive, and/or convective heat to control a temperature of the media. The mid-heater 30 brings the ink placed on the media to a temperature suitable for desired properties when the ink on the media is sent through the fixing assembly 40. The fixing assembly 40 is configured to apply heat and/or pressure to the media to fix the images to the media. The fixing assembly may include any suitable device or apparatus for fixing images to the media such as an image-side roller 42 and a pressure roller 44, both configured to apply heat and pressure to the media. Nip rollers 50 are provided at the outlet of the fixing assembly to guide the substrate to a receiving station (not shown).

The printing machine may use "phase-change ink," by which is meant that the ink is substantially solid at room temperature and substantially liquid when heated to a phase change ink melting temperature for jetting onto the imaging receiving surface. The phase change ink melting temperature may be at any temperature that is capable of melting solid phase change ink into liquid or molten form. In certain printing machines, the phase change ink melting temperature is approximately 70° C. to 140° C. The molten ink supply 24 for a phase-change ink system thus includes a melting station having a melter 25 that melts solid ink elements received from a hopper 26. In certain embodiments the solid ink elements are in the form of pellets that are fed from a solid ink supply 27 through a feed conduit 28 to the hopper. The supply 27 is replenishable, meaning that it can be re-filled with solid ink pellets or replaced with a fully loaded supply container.

High usage or throughput printing systems typically require large solid ink supplies 27 that do not require frequent replenishment. Thus, in such high throughput systems the supply is in the form of one or more large drums, such as a 55 gallon drum. A solid ink supply of this magnitude can accommodate high ink usage rates (on the order of 33 gallons per color per day) without placing an undue burden on the operator to constantly replace or replenish the solid ink supply.

SUMMARY

In one aspect of the disclosure a printing machine is provided comprising a substrate supply station, a molten ink supply, a printing station operable to receive a substrate from the substrate supply station and molten ink from the molten ink supply and apply the molten ink onto the substrate, and a fixing assembly for fixing the molten ink onto the substrate. The molten ink supply may comprise a container for storing solid ink pellets, a withdrawal tube having an inlet end disposed within the container and an outlet end, a vacuum generator at the outlet end of the withdrawal tube operable to draw a vacuum within the withdrawal tube, a feed conduit connected to the outlet end of the withdrawal tube for receiving solid ink pellets drawn therein by the vacuum generator, and a melter station receiving solid ink pellets from the feed conduit and operable to melt the solid ink pellets.

In a further aspect, the molten ink supply further comprises an assist tube connectable at one end to a source of pressurized gas and having a discharge nozzle at an opposite end positioned within the withdrawal tube at the inlet end. The discharge end is configured to direct a flow of gas effective to agitate solid ink pellets within the withdrawal tube.

In another feature, an apparatus is provided for feeding solid ink pellets from a container to a melter in a solid ink printing machine that comprises a withdrawal tube having an inlet end disposed within the container and an outlet end, a vacuum generator at the outlet end of the withdrawal tube operable to draw a vacuum flow within the withdrawal tube, and a feed conduit connected at one end to the outlet end of the withdrawal tube for receiving solid ink pellets drawn therein by the vacuum generator, and connectable at an opposite end to the melter. An assist tube may be provided that is connectable at one end to a source of pressurized gas and having a discharge nozzle at an opposite end positioned within the withdrawal tube at the inlet end. The discharge end is configured to direct a flow of gas effective to agitate solid ink pellets within the withdrawal tube.

A method may be further provided for supplying solid ink pellets from a container to a melting station in a solid ink printing machine that comprises introducing the inlet end of a withdrawal tube into a container of solid ink pellets, generating a vacuum at the outlet end of the withdrawal tube to draw a vacuum flow within the withdrawal tube sufficient to pull solid ink pellets through the withdrawal tube, and providing air flow through a feed conduit connected to the outlet end of the withdrawal tube sufficient to push the solid ink pellets through the conduit to the melting station connected thereto. The method may further comprise introducing a separate air flow within the withdrawal tube at the inlet end thereof, the separate air flow sufficient to agitate solid ink pellets contained within the withdrawal tube.

DETAILED DESCRIPTION

Figure 1:
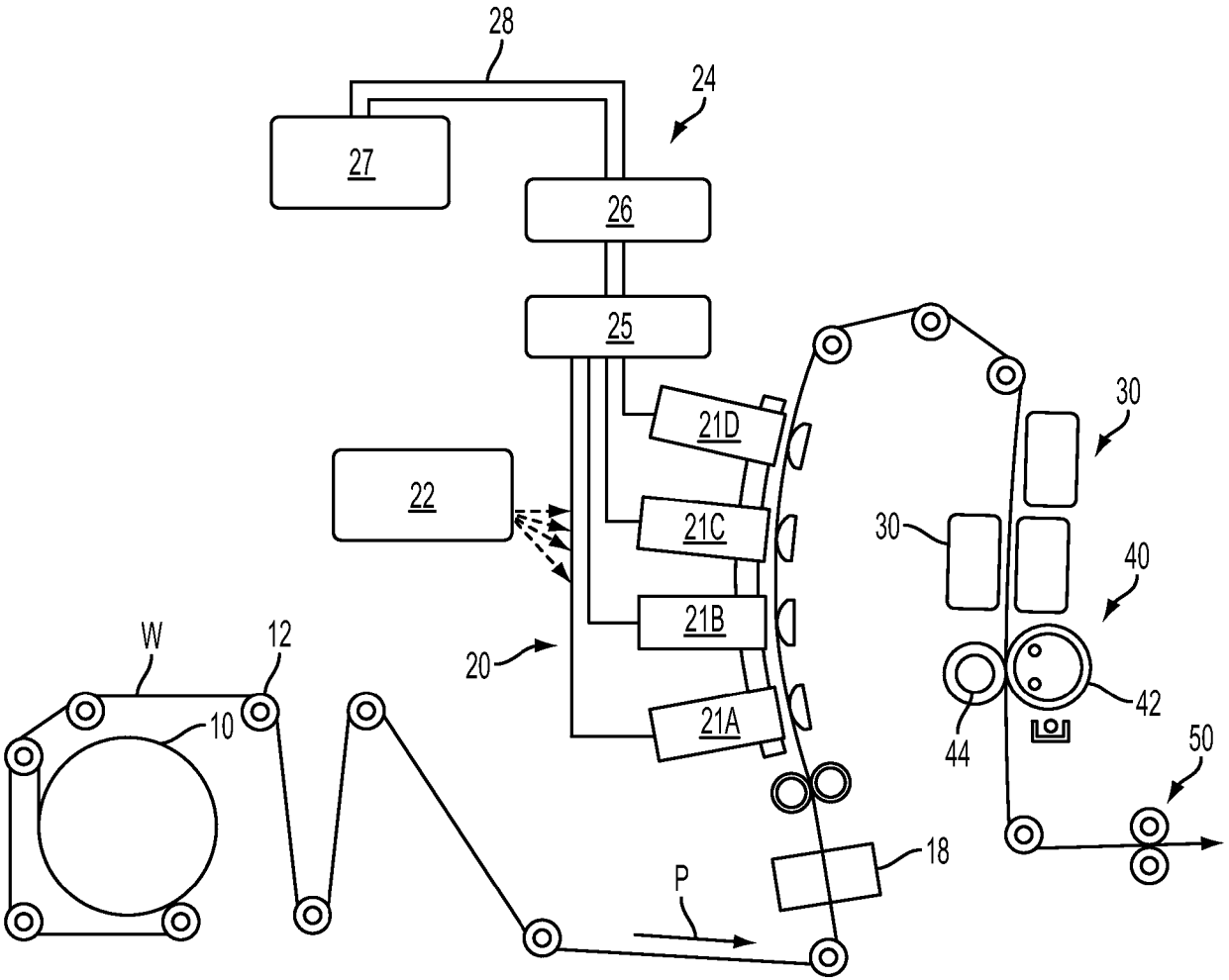
FIG. 1 is a representation of the components of a printing machine using phase-change ink.
Figure 2:
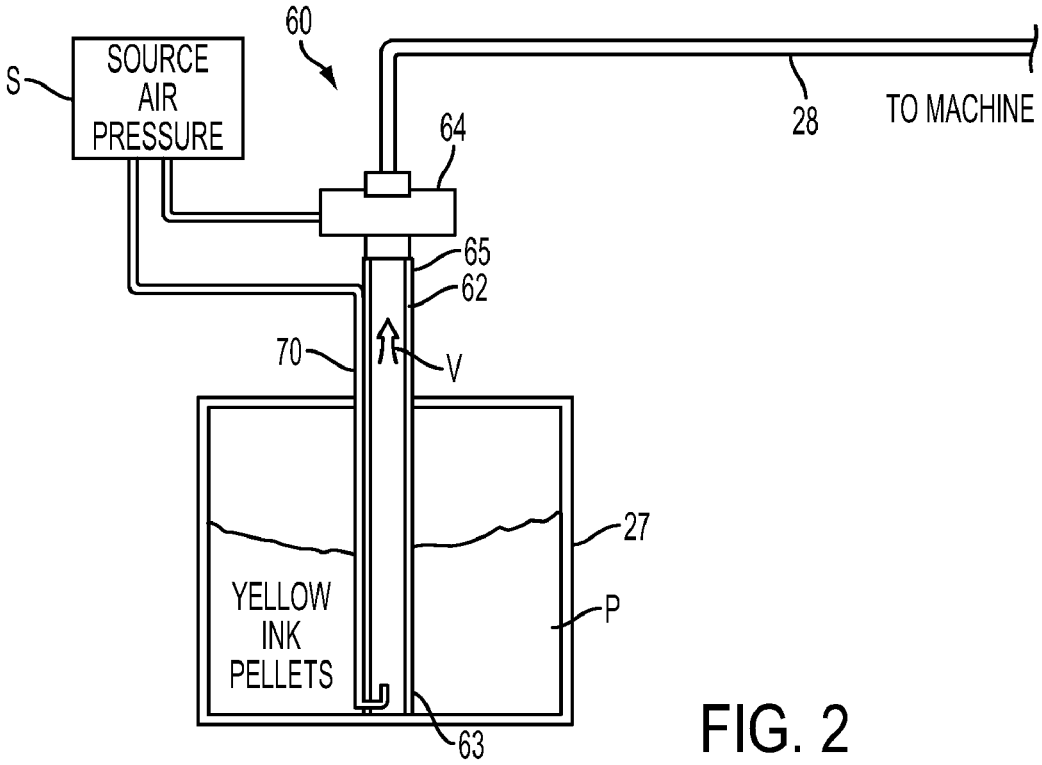
FIG. 2 is cut-away view of a solid ink supply disclosed herein.
Figure 3:
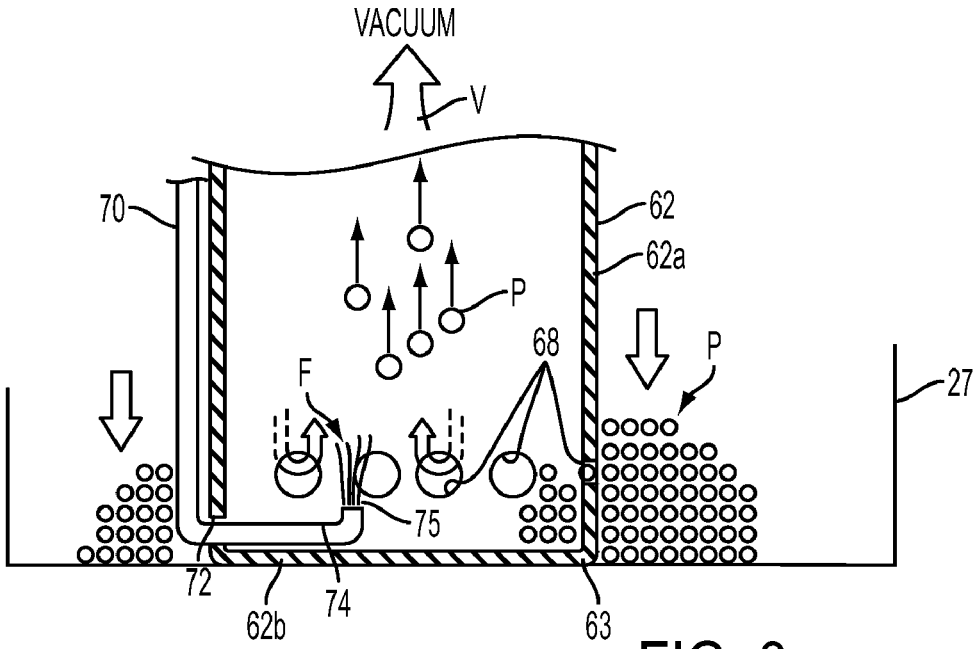
FIG. 3 is an enlarged partial cross-sectional view of the solid ink supply shown in FIG. 2.

Referring to FIGS. 2-3 the solid ink supply 27 is shown in the form of a drum or other container with a supply of pellets P disposed therein. A pellet feed apparatus 60 is provided that is operable to withdraw pellets from the supply container 27 and feed the pellets through the feed conduit 28 to the hopper 26 (FIG. 1). In one aspect, the pellet feed apparatus 60 includes a withdrawal tube 62 that extends into the supply container 27 with its inlet end 63 on or near the base of the supply container. A vacuum generator 64 is provided at the discharge end 65 of the withdrawal tube. The vacuum generator is operable to draw a vacuum V in the withdrawal tube 62 that is sufficient to pull the solid ink pellets P upward through the tube and to the feed conduit 28. The vacuum generator may be a venturi type device that utilizes pressurized gas from a source S. The pressurized gas source S may be a pressurized air source of the printing machine used to perform other functions of the machine.

Referring to FIG. 3, the inlet end 63 of the withdrawal tube 62 is provided with a series of openings 68 that are sized for passage of one or more pellets P. It can be appreciated that when the withdrawal tube is introduced into the supply container 27 a certain amount of pellets will spill through the openings 68 into the withdrawal tube. When the vacuum generator 64 is operated, the suction force V will draw those pellets upward and will also pull pellets from the supply container 27 through the openings 68 and into the withdrawal tube 62. Since the inlet end 63 is positioned near the bottom of the container gravity will continually direct the pellets downward and into the openings 68 as the pellets within the withdrawal tube 62 are moved upward. The openings 68 are formed in the side wall 62*a* of the withdrawal tube 62 and are arranged at a height above the base of the container so that during operation pellets entering the openings can be more readily pulled upward by the suction force V.

For certain solid ink pellets and supply container configurations the withdrawal tube 62 may have an inner diameter of about 25 mm (one inch) to accommodate pellets that are generally spherical with a diameter of about of 1 mm (0.04 inch). The openings 68 may have an effective diameter of about 3-5 mm (0.12-0.20 inch) so that the pellets may flow freely therethrough. In some cases the pellet diameters may range from 0.43-1.03 mm for color pellets and 1.0-9.0 mm for clear pellets. The openings 68 may thus be sized to readily accept these pellets, in some cases ranging from 9.5 to 12.5 mm in diameter. In one embodiment, the openings may have an effective diameter that is between about 1.3 and 5 times the diameter of the pellets.

The vacuum generator 64 provides an efficient method for withdrawing solid ink pellets from the supply container 27 and transporting the pellets through the feed conduit 28 to the hopper. However, certain difficulties arise with smaller pellet diameters. In particular, the smaller pellets bunch tightly together within the supply container 27, which inherently restricts air flow through the pellets in the container. Air flow through the pellets is necessary for the generation of the vacuum force V. While larger pellets permit adequate air flow through the mound of pellets within the container, the larger size of the pellets makes them heavier and harder to draw up through the tube without significantly increasing the vacuum produced by the vacuum generator 64. Moreover, larger pellets may present design issues with respect to the hopper 26 and melter 25 of the molten ink supply 24 (FIG. 1).

In order to address the air flow concerns associated with smaller pellet diameters, the pellet feed apparatus 60 may include an assist tube 70 that receives pressurized air from the source S. The assist tube 70 extends along the withdrawal tube 62 and includes an arm 74 that extends into the interior of the withdrawal tube at the inlet end 63 of the tube. The withdrawal tube 62 may be provided with an opening 72 through which the arm 74 of the assist tube extends. The opening 72 may be sized to fit tightly around the assist tube arm 74 to prevent pellets from becoming lodged therein.

The assist tube 70 includes a discharge nozzle 75 that is directed at least partially upward along the length of the withdrawal tube. Pressurized air fed from the source S to the assist tube thus provides a flow of air F from the discharge nozzle 75 that helps dislodge and agitate pellets that may accumulate at the bottom of the withdrawal tube. The air flow F also provides adequate background air flow to allow the vacuum generator 64 to operate consistently without any significant variation in pellet feed rates through the pellet feed apparatus 60.

The assist tube 70 may be provided with different discharge nozzle 75 configurations. For instance, the assist tube may include multiple arms 74 and associated discharge nozzles that are oriented in proximity to each pellet feed opening 68 in the withdrawal tube 62. The discharge nozzle or nozzles may be arranged at different orientations within the withdrawal tube, rather than the vertical orientation shown in FIG. 3. The nozzle(s) may also be configured to provide a wider or narrow flow pattern F. The discharge nozzle 75 may be configured to be below the height of the openings 68 so that the air flow impinges on pellets as they enter the openings. In another embodiment, the arm 74 may be sized and configured to span the base 62*b* of the container and may be provided with a plurality of upwardly directed openings serving as discharge nozzles 75.

In a specific example, the pellet supply container 27 is a 55 gallon drum storing pellets having a diameter of about 1 mm. The withdrawal tube 62 has a diameter of about 25 mm with the vacuum V being pulled by a 10 psi air supply to the vacuum generator 64. The assist tube in this example may have a diameter of about 9 mm (0.38 inch). Air is provided to the assist tube 70 at about 7 psi. With this configuration the pellet feed apparatus 60 is capable of delivering solid ink pellets at a rate of about 218 grams per minute with substantially uniform, uninterrupted flow.

The withdrawal tube and assist tube may be formed of metal, plastic or other material suitable for continuous contact with solid-ink pellets and capable of sustaining continuous air flow therethrough. The vacuum generator may be an in-line venturi device, or other suitable device capable of generating a vacuum flow sufficient to transport solid ink pellets and a discharge flow sufficient to propel the pellets through the feed conduit. The vacuum generator and assist tube may be connected to a common air pressure source that is part of the printing machine, external to the machine or part of the pellet supply system. A regulator may be provided to regulate the air pressure provided to each component. The venturi device and assist tube may operate with a gas other than air that is inert to the solid ink pellets. Sensors may be provided to automatically stop air flow to the components when the pellet supply is empty.

In the illustrated embodiment, the assist tube 70 is separate from and exterior to the withdrawal tube 62. However, the assist tube may be associated with the withdrawal tube in other ways. For instance, the assist tube may be attached to the inside of the withdrawal tube, or the assist and withdrawal tubes may be integrally formed. Moreover, the withdrawal tube is shown with a bottom wall 62*b* at the inlet end 63, which can help maintain the vacuum flow within the discharge tube. Alternatively, the inlet end of the withdrawal tube may be open with the tube configured to be engaged within the container 27 with the open inlet end 63 bearing against the base of the container in sealed engagement.

It is contemplated that the pellet feed apparatus 60 may be integrated into the printing machine and arranged to be inserted into a new ink supply container. Alternatively, the pellet feed apparatus may be integrated into the ink supply container or associated with a removable lid or cover for a re-fillable container. The pellet feed apparatus 60 may be provided with appropriate fittings on the venturi vacuum generator 64, withdrawal tube 62 and/or assist tube 70 for simple and quick connection to the printing machine. For printing machines that already include a vacuum or suction element, the venturi vacuum generator 64 may be eliminated from the apparatus 60 and the withdrawal tube 62 provided with a fitting to engage the existing suction element of the printing machine.

It will be appreciated that various of the above-described features and functions, as well as other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A printing machine comprising:
a substrate supply station;
a molten ink supply including;
a container for storing solid ink pellets;
a withdrawal tube having an outlet end and an inlet end disposed within said container, said inlet end configured to receive pellets from said container;
a vacuum generator at said outlet end of said withdrawal tube operable to draw a vacuum within said withdrawal tube;
a feed conduit connected to said outlet end of said withdrawal tube for receiving solid ink pellets drawn therein by said vacuum generator;
an assist tube connectable at one end to a source of pressurized gas and having a discharge nozzle at an opposite end positioned relative to said withdrawal tube at said inlet end, said discharge end configured to direct a flow of gas effective to agitate solid ink pellets within said withdrawal tube; and
a melter station receiving solid ink pellets from said feed conduit and operable to melt the solid ink pellets;
a printing station operable to receive a substrate from the substrate supply station and molten ink from said molten ink supply and apply the molten ink onto the substrate; and
a fixing assembly for fixing the molten ink onto the substrate.

2. The printing machine of claim 1, wherein said withdrawal tube includes a number of openings defined at said inlet end, each sized for passage of at least one solid ink pellet therethrough.

3. The printing machine of claim 2, wherein said withdrawal tube is sized so that outlet end is outside said container and said inlet end is adjacent the bottom of the container so that pellets can flow by gravity through said number of openings.

4. The printing machine of claim 3, wherein:
said number of openings are arranged at a height above the bottom of said container; and
said discharge end is arranged below said number of openings.

5. The printing machine of claim 2, wherein:
said pellets have a diameter; and
said number of openings have an effective diameter equal to about 1.5 to 5 times greater than the diameter of said pellets.

6. The printing machine of claim 1, wherein said vacuum generator is an in-line venturi device connectable to a source of pressurized gas.

7. The printing machine of claim 1, wherein said discharge nozzle is oriented to direct the flow of gas in the direction of the vacuum flow within the withdrawal tube.

8. The printing machine of claim 1, wherein said withdrawal tube has an inner diameter of about 25 mm and said assist tube has an inner diameter of about 9 mm.

9. A molten ink supply for a printing machine, comprising:
a container for storing solid ink pellets;
a withdrawal tube having an outlet end and an inlet end disposed within said container, said inlet end configured to receive pellets from said container;
a vacuum generator at said outlet end of said withdrawal tube operable to draw a vacuum within said withdrawal tube;
a feed conduit connected to said outlet end of said withdrawal tube for receiving solid ink pellets drawn therein by said vacuum generator;
an assist tube connectable at one end to a source of pressurized gas and having a discharge nozzle at an opposite end positioned relative to said withdrawal tube at said inlet end, said discharge end configured to direct a flow of gas effective to agitate solid ink pellets within said withdrawal tube; and
a melter station receiving solid ink pellets from said feed conduit and operable to melt the solid ink pellets.

10. The molten ink supply of claim 9, wherein said withdrawal tube includes a number of openings defined at said inlet end, each sized for passage of at least one solid ink pellet therethrough.

11. The molten ink supply of claim 10, wherein said withdrawal tube is sized so that outlet end is outside said container and said inlet end is adjacent the bottom of the container so that pellets can flow by gravity through said number of openings.

12. The molten ink supply of claim 11, wherein:

said number of openings are arranged at a height above the bottom of said container; and said discharge end is arranged below said number of openings.

13. The molten ink supply of claim 10, wherein:

said pellets have a diameter; and said number of openings have an effective diameter equal to about 1.5 to 5 times greater than the diameter of said pellets.

14. The molten ink supply of claim 9, wherein said vacuum generator is an in-line venturi device connectable to a source of pressurized gas.

15. The molten ink supply of claim 9, wherein said withdrawal tube has an inner diameter of about 25 mm and said assist tube has an inner diameter of about 9 mm.

16. The molten ink supply of claim 9, wherein said discharge nozzle is oriented to direct the flow of gas in the direction of the vacuum flow within the withdrawal tube.

17. An apparatus for feeding solid ink pellets from a container to a melter in a solid ink printing machine, comprising:

a withdrawal tube having an inlet end and an inlet end, said withdrawal tube sized so that said inlet end is disposed within said container and said outlet end is outside said container;

a feed conduit connected at one end to said outlet end of said withdrawal tube for receiving solid ink pellets drawn therein by said vacuum generator, and connectable at an opposite end to the melter; and an assist tube connectable at one end to a source of pressurized gas and having a discharge nozzle at an opposite end positioned relative to said withdrawal tube at said inlet end, said discharge end configured to direct a flow of gas effective to agitate solid ink pellets within said withdrawal tube.

18. The apparatus for feeding solid ink pellets of claim 17, wherein said withdrawal tube includes a number of openings defined at said inlet end, each sized for passage of at least one pellet therethrough.

19. The apparatus for feeding solid ink pellets of claim 18, wherein said withdrawal tube is sized so that when outlet end is outside said container said inlet end is adjacent the bottom of the container so that pellets can flow by gravity through said number of openings.

20. The apparatus for feeding solid ink pellets of claim 19, wherein:

said number of openings are arranged at a height above the bottom of said container; and said discharge end is arranged below said number of openings.

21. The apparatus for feeding solid ink pellets of claim 18, wherein:

said pellets have a diameter; and said number of openings have an effective diameter equal to about 1.5 to 5 times greater than the diameter of said pellets.

22. The apparatus for feeding solid ink pellets of claim 17, further comprising a vacuum generator at said outlet end of said withdrawal tube operable to draw a vacuum within said withdrawal tube.

23. The apparatus for feeding solid ink pellets of claim 22, wherein said vacuum generator is an in-line venturi device connectable to a source of pressurized gas.

24. The apparatus for feeding solid ink pellets of claim 17, wherein said discharge nozzle is oriented to direct the flow of gas in the direction of the vacuum flow within the withdrawal tube.

25. The apparatus for feeding solid ink pellets of claim 17, wherein said withdrawal tube has an inner diameter of about 25 mm and said assist tube has an inner diameter of about 9 mm.

26. A method for supplying solid ink pellets from a container to a melting station in a solid ink printing machine, comprising:

introducing the inlet end of a withdrawal tube into a container of solid ink pellets, the inlet end configured to receive pellets therein;

generating a vacuum at the outlet end of the withdrawal tube to draw a vacuum flow within the withdrawal tube sufficient to pull solid ink pellets through the withdrawal tube;

providing air flow through a feed conduit connected to the outlet end of the withdrawal tube sufficient to push the solid ink pellets through the conduit to the melting station connected thereto; and introducing a separate air flow within the withdrawal tube at the inlet end thereof, the separate air flow sufficient to agitate solid ink pellets contained within the withdrawal tube.

27. The method for supplying solid ink pellets of claim 26, wherein:

the vacuum is generated by a venturi device receiving air at a pressure of about 10 psi; and the separate air flow is introduced at a pressure of about 7 psi.

28. The method for supplying solid ink pellets of claim 26, wherein said separate air flow is provided in substantially the same direction as the vacuum flow.

29. The method for supplying solid ink pellets of claim 26, wherein the inlet end includes a number of openings offset a height from the bottom of said withdrawal tube and the step of introducing the inlet end into the container includes positioning the inlet end with the openings are offset from the bottom of the container so pellets feed in part by gravity through the openings.

* * * * *